US006109758A

United States Patent [19]

Lo

[11] Patent Number: 6,109,758

[45] Date of Patent: Aug. 29, 2000

[54] BRIGHTNESS ENHANCING STRIP FOR GAME TABLES

[76] Inventor: Allen Kwok Wah Lo, 5022 Hidden Branches Dr., Dunwoody, Ga. 30338

[21] Appl. No.: 09/034,638

[22] Filed: Mar. 4, 1998

Related U.S. Application Data

[63] Continuation-in-part of application No. 08/874,471, Jun. 16, 1997, Pat. No. 5,794,935.

[51] Int. Cl.[7] ..... F21V 33/00; F21V 7/00

[52] U.S. Cl. ..... 362/33; 362/346; 362/253; 273/236

[58] Field of Search ..... 362/33, 97, 346, 362/297, 253; 273/236, 287

[56] References Cited

U.S. PATENT DOCUMENTS

| | | | |
|---|---|---|---|
| 1,377,184 | 5/1921 | Comstock | 362/297 X |
| 1,805,224 | 5/1931 | Oestnaes | 362/346 X |
| 4,190,355 | 2/1980 | Avery et al. | 362/297 X |
| 5,724,183 | 3/1998 | Yoshida | 362/346 X |
| 5,791,758 | 8/1998 | Horgan et al. | 362/253 X |

*Primary Examiner*—Laura K. Tso

[57] ABSTRACT

This disclosure is concerned with a brightness enhancing strip having a plurality of light reflecting facets for lining along the rims of a game table top. When one or more light sources located above the table top are used to illuminate the table top, some of light rays reaching the strips are reflected toward the center portion of the table top. Such strips are useful for enhancing the brightness of the game table and the game pieces that are placed facing the strips and away from the table rim. Moreover, the strip can be made of a sturdy material so it can also be used as a ruler for aligning a row of game pieces.

21 Claims, 8 Drawing Sheets

BRIGHTNESS ENHANCING STRIP FOR GAME TABLES

This is a continuation-in-part application Ser. No. 08/874,471, filed Jun. 16, 1997, now U.S. Pat. No. 5,794, 935.

BACKGROUND OF THE INVENTION

In a Mahjong game or another tile game, a number of players are seated around a table to play with a set of game pieces or tiles. Each player is given a number of tiles and the objective of the game is for each of the players to assemble the tiles in the hand into a certain pattern by taking turns to exchange the tiles in the hand with those on the table. Usually, each player's tiles are placed in an upright position such that the face of the each tile is facing the player so as to allow the player to see the assembling pattern of the tiles in the hand and, at the same time, to conceal the face of the tiles from other players. When the game is played indoor or in the evening where natural lighting is not adequate, a light source placed above the table is usually used for illumination. On the tiles that face the players, however, such illumination does not produce desirable brightness because the tile's own shadow would cast over the face of each tile.

It is desirable to provide a simple means for enhancing the brightness on a game table to allow each of the players to see his or her own set of game pieces more clearly.

SUMMERY OF THE INVENTION

It is an objective of the present invention to provide a means for enhancing the brightness on a game table without using additional light sources.

It is another objective of the present invention to provide a means for enhancing the brightness on the game pieces facing the players which are seated around the game table.

It is yet another objective of the present invention to provide a simple means for enhancing the brightness on a game table with the enhancing means being non-intrusive and non-interfering.

The above objectives can be achieved by providing a plurality of brightness enhancing strips around the rim portion of a game table top. The brightness enhancing strip comprises a plurality of light-scattering or reflecting facets to direct light rays toward the center portion of the table top. When the strip is illuminated by one or more light sources located above the game table, it enhances the brightness on the game pieces that are placed away from the rim, facing the strip.

Preferably, the strips are thin and flat so as not to be too intrusive and interfering. The strips can be made flexible so they are easily attachable to the table top, or they can be made with sturdy material so that they can also be used as rulers for aligning the game pieces in a Mahjong game.

The objectives of the present invention will become apparent upon reading the description of the drawing figures.

DETAILED DESCRIPTION OF THE INVENTION

Figure 1:
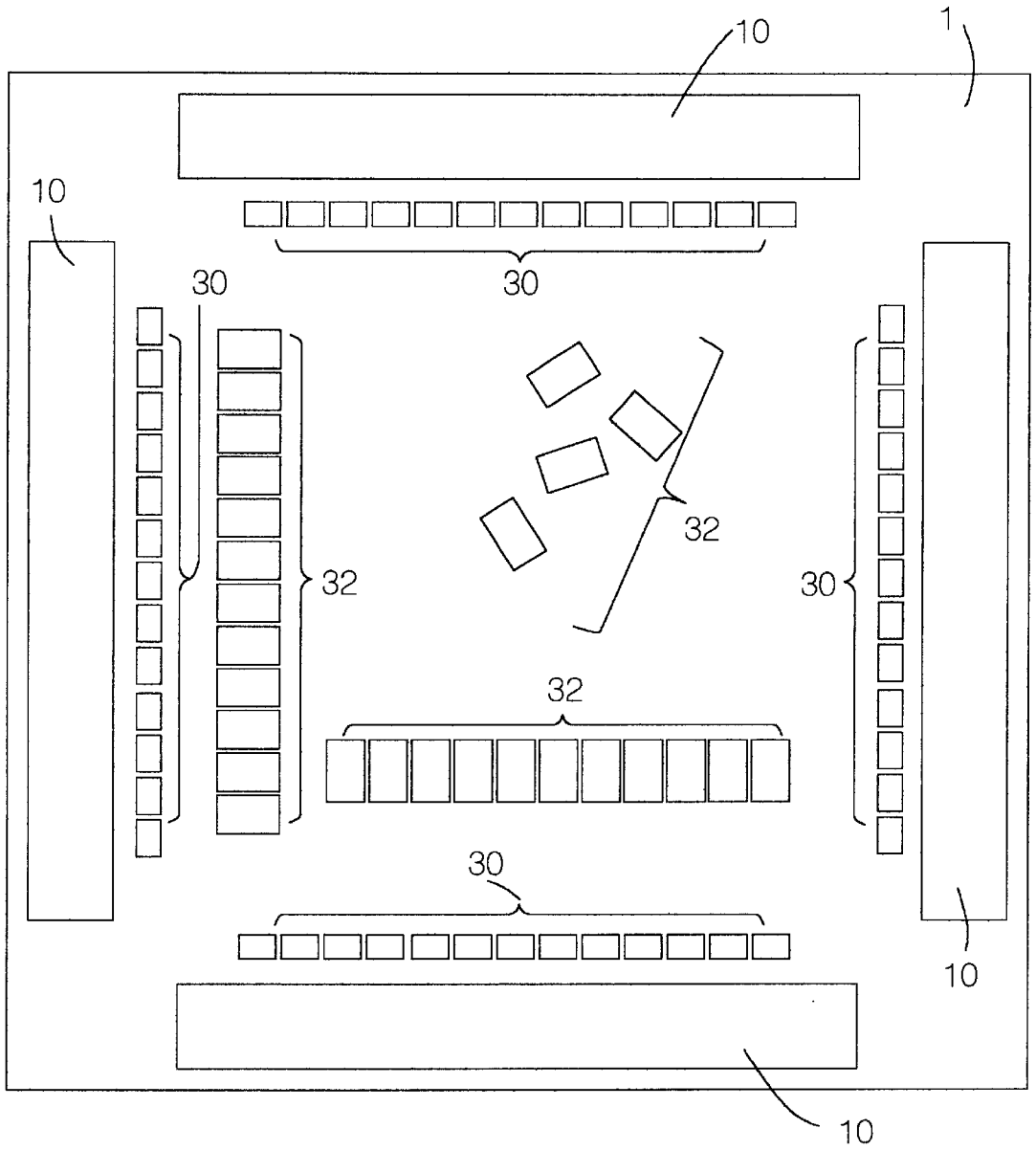
FIG. 1 shows the arrangement of a plurality of brightness enhancing strips around the rim portion of a game table top.

FIG. 1 shows the arrangement of a plurality of brightness enhancing strips around the rim portion of a game table top. In FIG. 1, numeral 1 denotes a square table top and numeral 10 denotes each of the four brightness enhancing strips disposed about the rim portion of the table top 1. Numeral 30 denotes the game pieces that are placed facing the brightness enhancing strips while numeral 32 denotes other game pieces on the table. The strips 10 should be sufficiently long so as to enhance the brightness on the entire row of game pieces 30 facing each strip. The strips may or may not be long enough to form an enclosed loop. Preferably, the strips 10 are narrow in width so as not to occupy too large an area of the table top. Also, preferably, the strips are sufficiently thin so as not to be intrusive or interfering.

Figure 2:
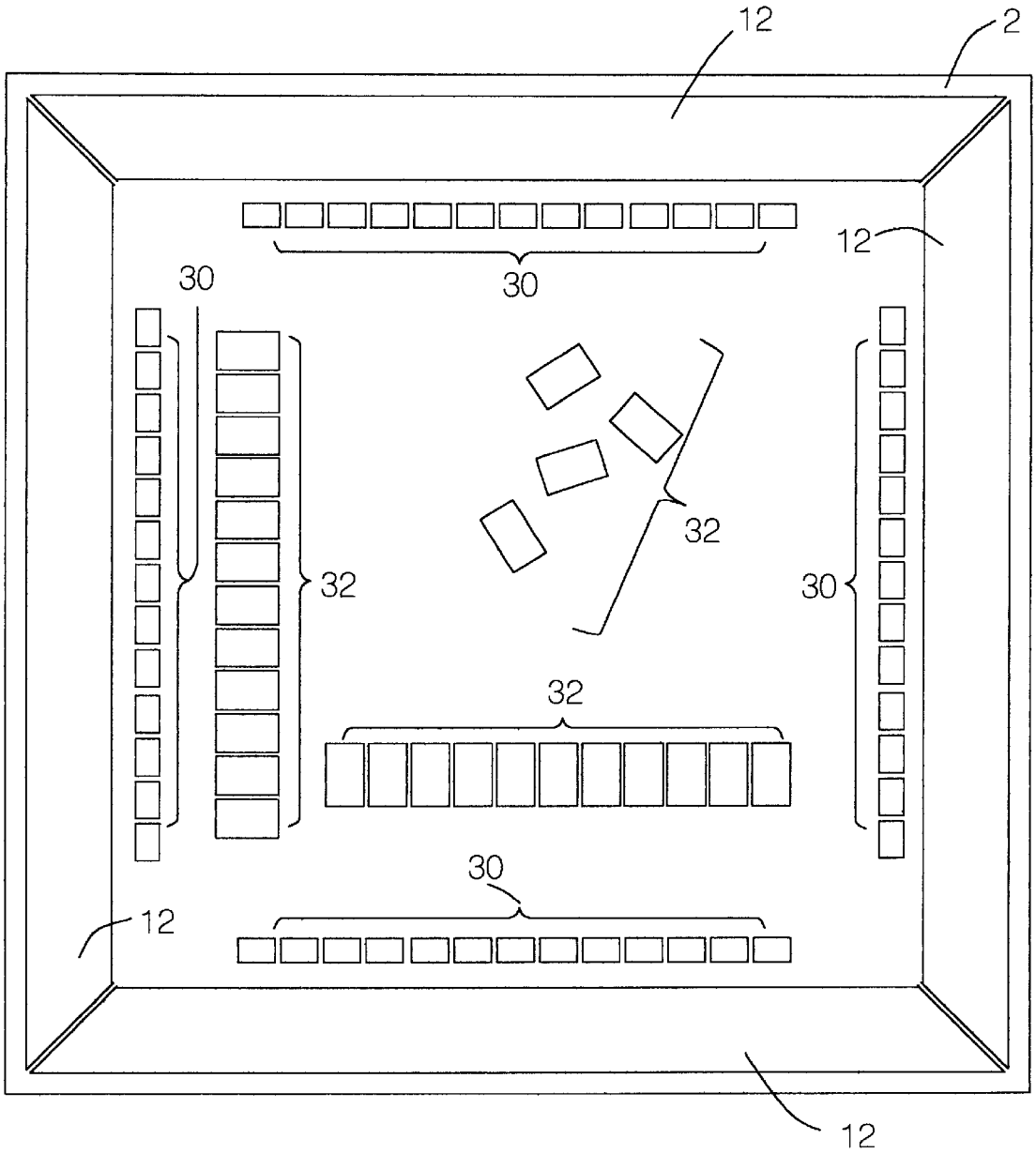
FIG. 2 shows another arrangement of the brightness enhancing strips around the rim portion of a game table top.

FIG. 2 shows another arrangement of the brightness enhancing strips around the rim portion of a game table top or a mat. In FIG. 2, numeral 2 denotes a mat to be used on a game table top, and numeral 12 denotes each of the four brightness enhancing strips disposed about the rim portion of the mat 2. As shown, the strips are sufficiently long to touch each other to form an enclosed loop. But they can be shorter. The strips can be detachable from the mat or they can be integral to the mat. Moreover, the strips can be narrow to cover only a portion of the surface area of the mat 2, but they can be wide to cover a large part of the mat or the entire surface area of the mat.

Figure 3:
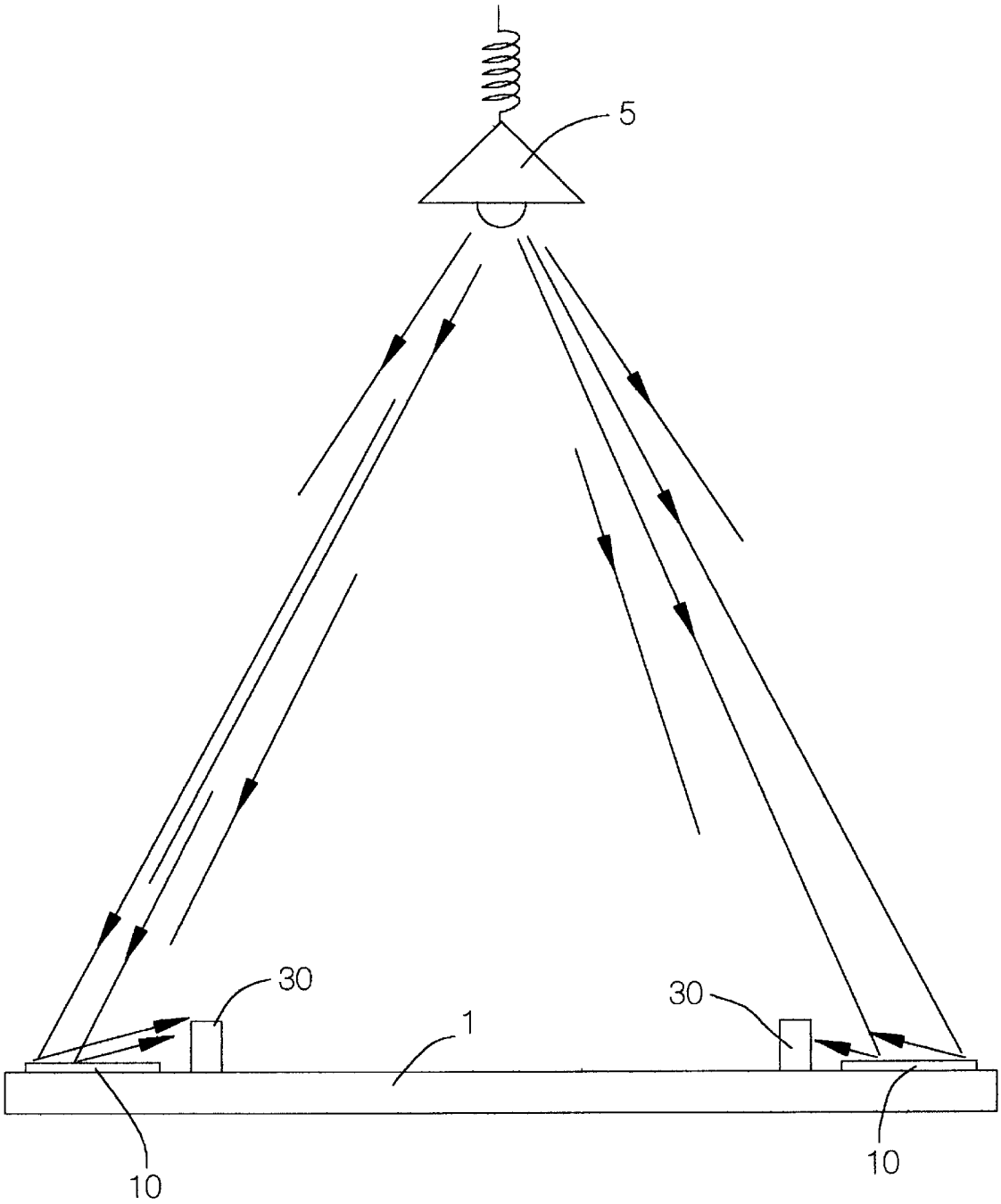
FIG. 3 shows the location of the brightness enhancing strips in relation to the illuminating light source.

FIG. 3 shows the location of the brightness enhancing strips in relation to the illuminating light source. FIG. 3 shows the side view of the table top 1 and the cross section of the brightness enhancing strips 10. One strip is placed along the left rim and one is placed along the right rim of the table. Numeral 30 denotes the game pieces that are placed near the rim portion of the table top, facing the strips 10. Numeral 5 denotes a light source located above the table top to provide illumination.

Figure 4:
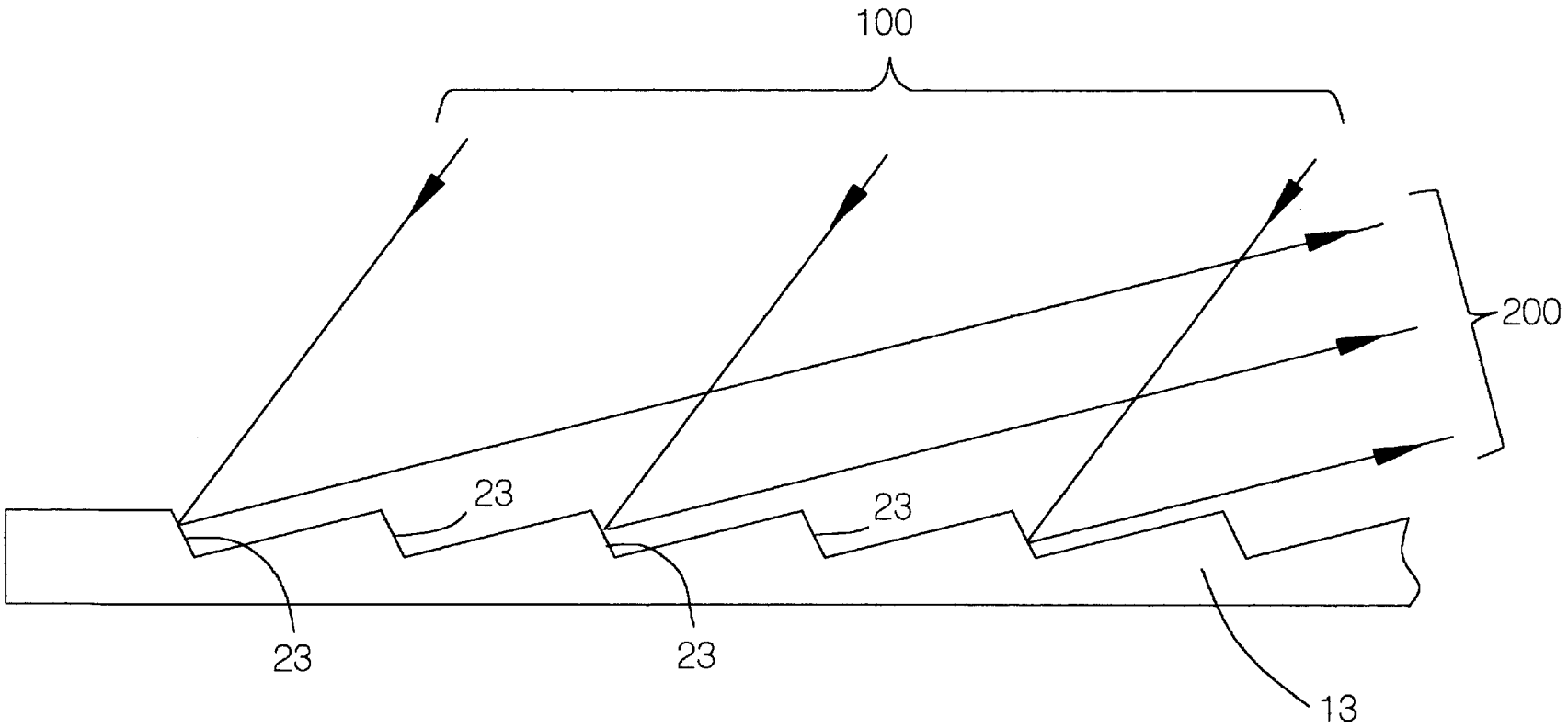
FIG. 4 illustrates a plurality of light reflecting facets distributed on the upper surface of a brightness enhancing strip.
Figure 5:
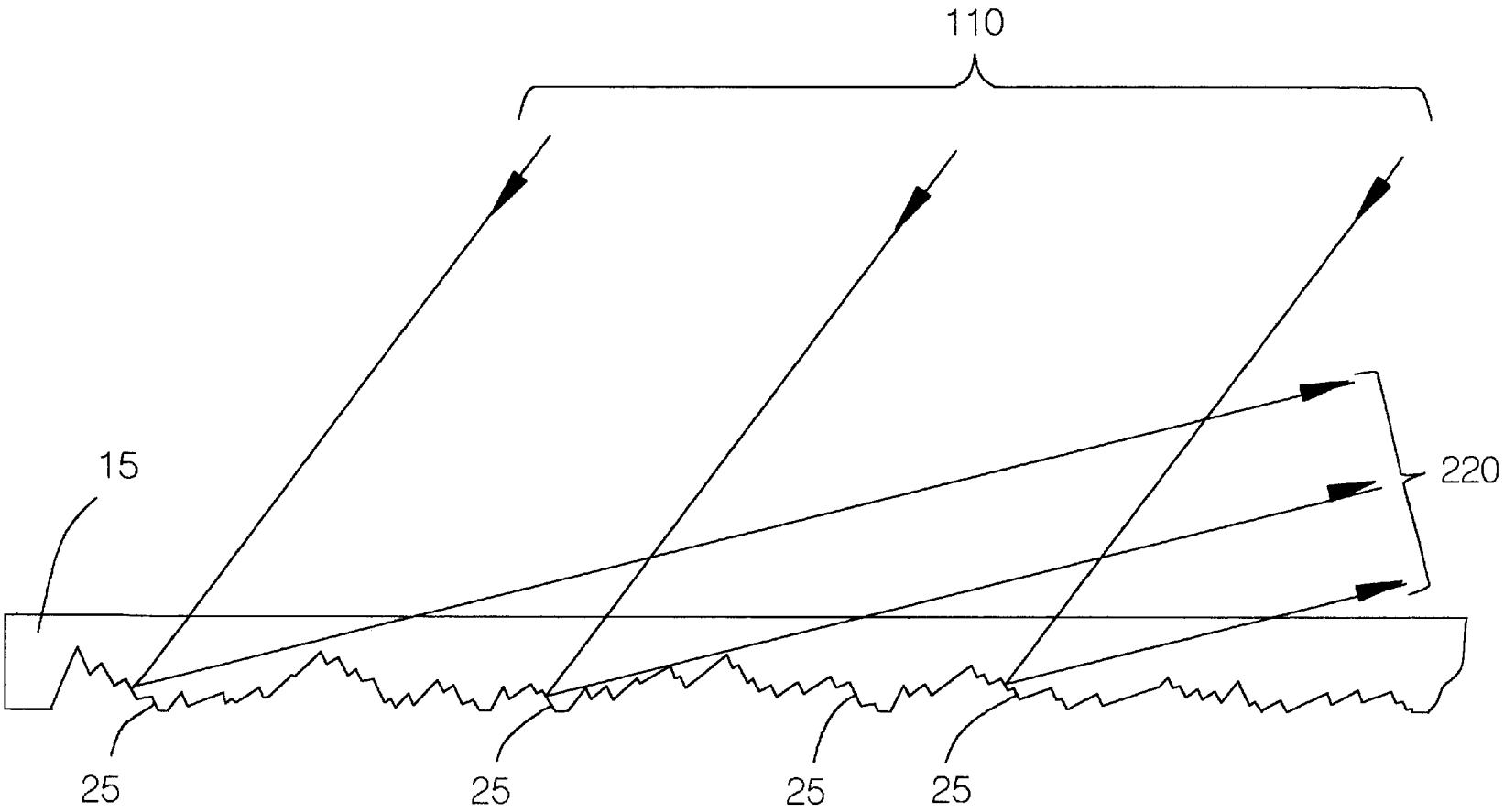
FIG. 5 illustrates a plurality of light reflecting facets distributed on the lower surface of a brightness enhancing strip.

FIG. 4 illustrates a plurality of light reflecting facets located on the upper surface of a brightness enhancing strip. FIG. 4 shows a cross section of a brightness enhancing strip 13 which can be a short strip like the strips 10 shown in FIG. 1 or a longer strip like the strips 12 shown in FIG. 2. The brightness enhancing strip 13 comprises an array of facets, collectively denoted by numeral 23, for reflecting light. As shown, light rays 100 descend upon the strip from the upper right corner as if the strip is placed along the left rim of the table top and is illuminated by a light source located above the center of the table. As the light rays reach the upper surface of the strip 13, some of the rays are reflected by the facets 23 and directed towards the right. The reflected light rays are collectively denoted by numeral 200. As the light rays 200 are directed towards the right, they enhance the brightness on the game pieces that are placed to the right of the strip. The facets 23 can be part of an array of grooves or channels running parallel to the table rim. In order to increase the reflection, the facets 23 may have a bright color or metallic color. It should be noted that the light reflecting facets 23 shown in FIG. 4 are distributed on the upper surface of the brightness enhancing strips 13. But the reflecting facets can also located on the lower surface of the strips as shown in FIG. 5. Furthermore, the facets can be distributed on the surface in an orderly fashion as illustrated in FIG. 4, but they can be distributed in a random fashion as illustrated in FIG. 5.

FIG. 5 illustrates a plurality of light reflecting facets distributed on the lower surface of a brightness enhancing strip. FIG. 5 shows a cross section of another brightness enhancing strip 15 which comprises a plurality of facets, collectively denoted by numeral 25, for reflecting light. As light rays 110 descend upon the strip 15 from the upper right corner, some of the light rays are reflected by the facets 25 and directed towards the right. The reflected light rays, which are collectively denoted by numeral 220, can enhance the brightness on the game pieces placed to the right of the strip. It should be noted that the light reflecting facets 25 on the brightness enhancing strip 15 are located on the lower surface thereof It is preferred that the brightness enhancing strip 15 itself is transparent or translucent so as to allow light rays descending upon the strip to reach the facets 25 efficiently for reflection. The strips 15 can be used to line the rim portion of a game table top or a mat. They can also be integral to a mat. As shown in FIG. 5, the facets are distributed in a random fashion. But they can also be distributed in an orderly fashion as those depicted in FIG. 4.

Figure 6A:
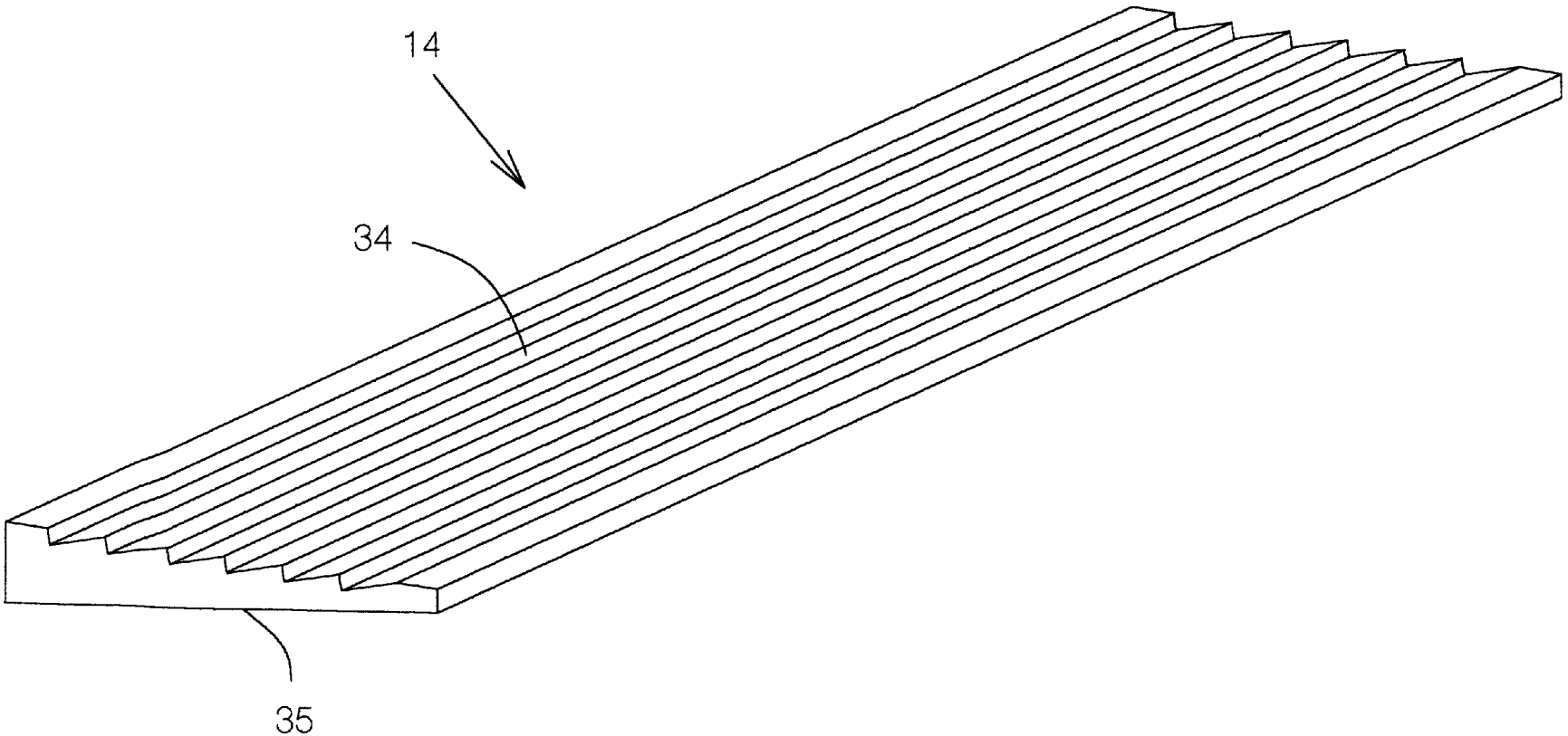
FIG. 6A illustrates a brightness enhancing strip which can also be used as a ruler for aligning the game pieces.

FIG. 6A illustrates a brightness enhancing strip which can also be used as a ruler for aligning a row of the game pieces in a Mahjong game or a similar game. As shown in FIG. 6A, the brightness enhancing strip 14 has a flat lower surface 35 and an upper surface 34 having a multiplicity of light reflecting facets. Preferably, the strip 14 is made of a sturdy material such as wood, plastic or metal, so that the strip can be used as a ruler for aligning the game pieces.

Figure 6B:
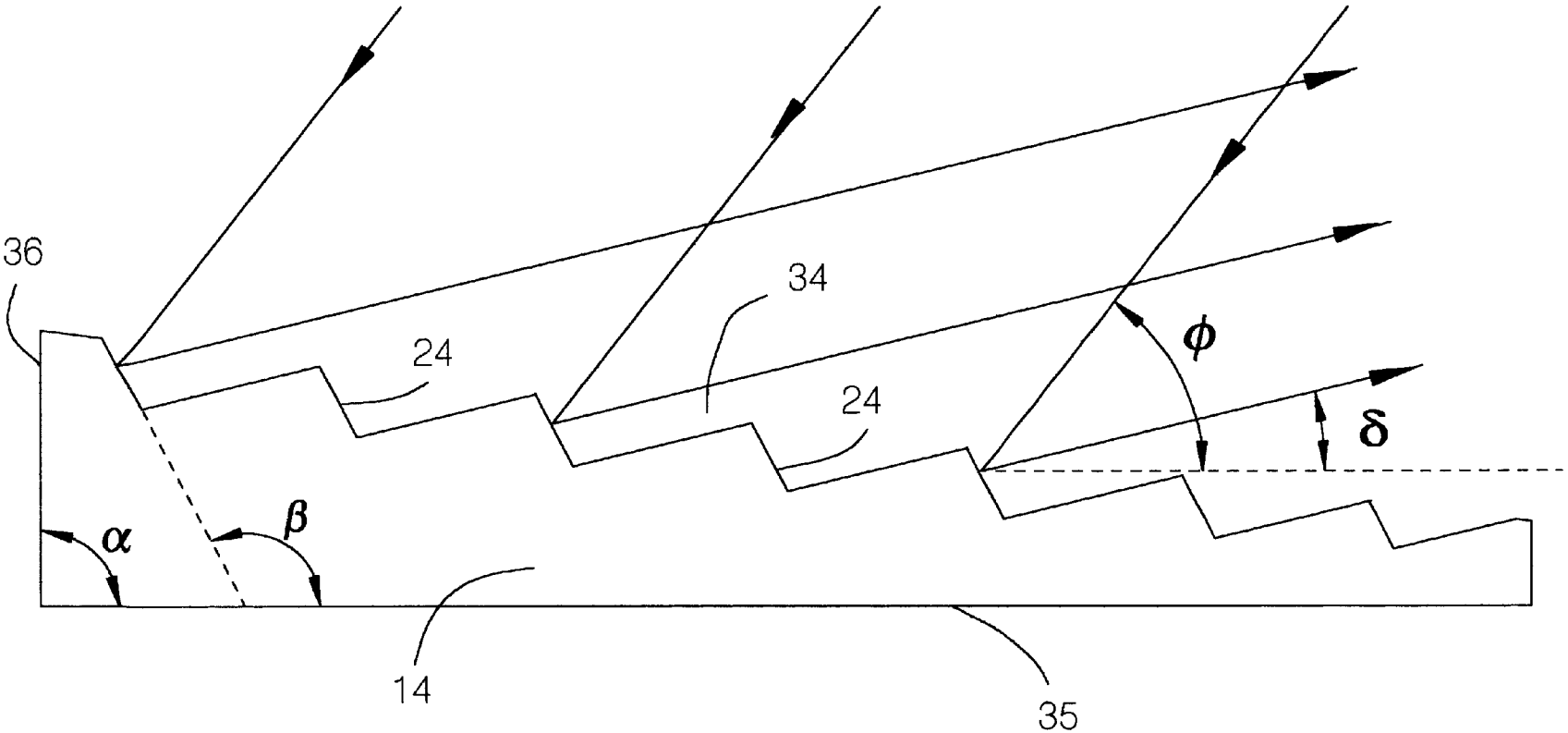
FIG. 6B illustrates the cross-section of the brightness enhancing strip of FIG. 6A.

FIG. 6B illustrates the cross-section of the brightness enhancing strip of FIG. 6A, showing a multiplicity of light reflecting facets 24. Preferably, the inclination angle, $\beta$, of the facets 24 is between 105 and 135 degrees so that any incoming beam having an incident angle $\phi$ ranging from 30 to 80 degrees can be reflected at an angle $\delta$ ranging from 0 to 10 degrees. Furthermore, it is preferred that the angle, $\alpha$, between the flat lower surface 35 and the back surface 36 is substantially equal to 90 degree. As shown in FIG. 6B, the general thickness of the cross-section is different from one end to another. As shown, the general thickness on the side having angle $\alpha$ is greater than the opposite side. However, the general thickness can be made the same as shown in FIG. 4.

Figure 6C:
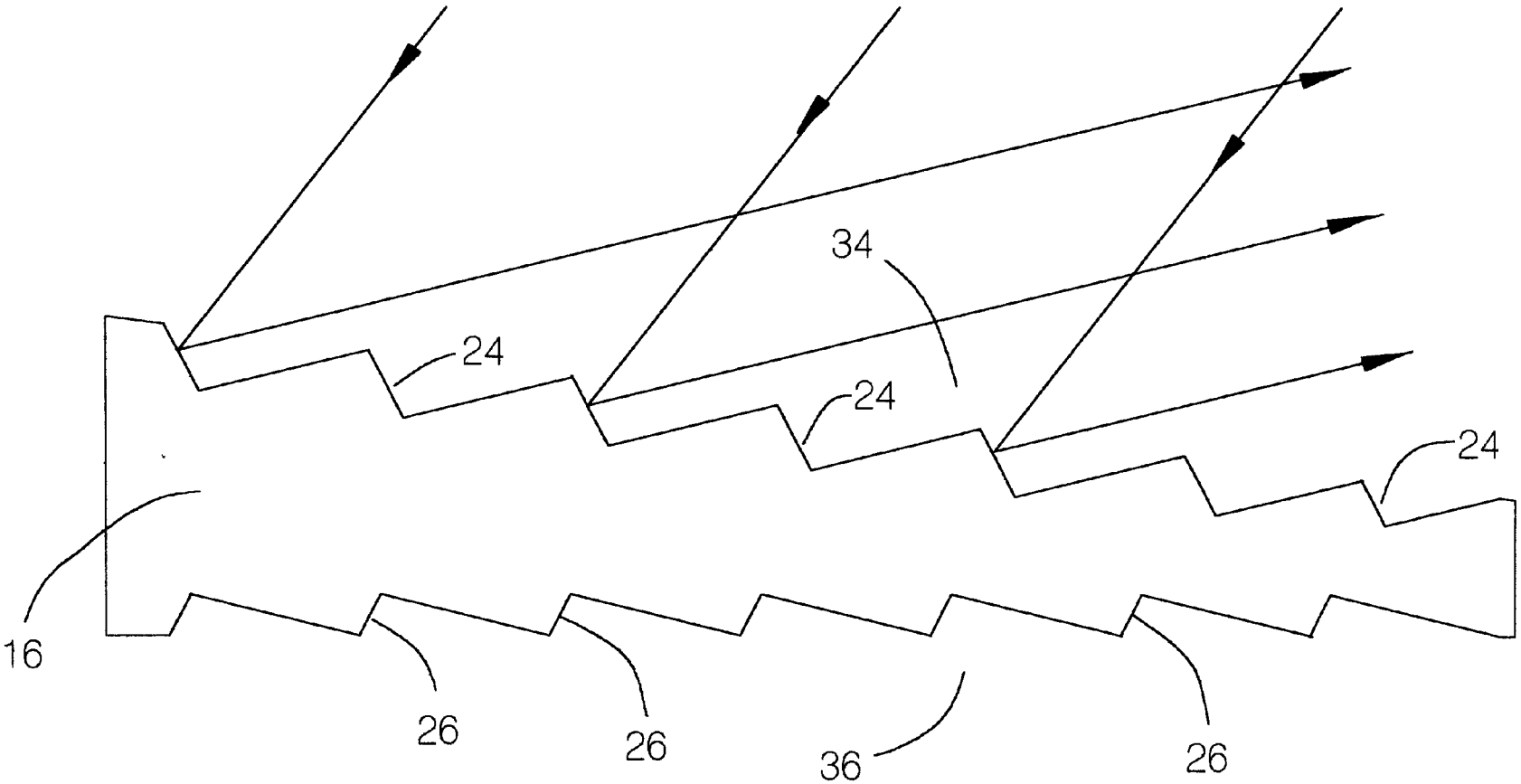
FIG. 6C illustrates the cross-section of another brightness enhancing strip with reflecting facets on both upper and lower surfaces.

FIG. 6C illustrates the cross-section of another embodiment of the brightness enhancing strip. As shown, the brightness enhancing strip 16 has reflecting facets 24 on its upper surface 34 and facets 26 on the lower surface 36. Preferably, the inclination angle of reflecting facets 26 is different from that of reflecting facets 24 so as to allow the user the choose a surface that better suits the illumination.

While the present invention has been disclosed in preferred forms and the drawing figures are for illustrative purposes only, it shall be understood by those skilled in the art that many modifications, additions and deletions can be made therein without departing from the scope of the invention as set forth in the appended claims.

What is claimed is:

1. A surface strip to enhance the brightness of a table top when said table top is illuminated by at least one light source located above said table top, said strip having an upper surface and a lower surface, said strip comprising:

a plurality of facets to reflect light rays towards a center portion of said table top when said strip is disposed about a rim portion of said table top, wherein said facets are located on the lower surface of said strip, said strip being sufficiently transparent so as to allow light rays descending upon the upper surface of said strip to reach the facets for reflection.

2. The strip of claim 1 wherein said facets are distributed in an orderly fashion.

3. The strip of claim 1 wherein said facets are distributed in a random fashion.

4. The strip of claim 2 wherein the inclination angle of the facets is between 105 and 135 degrees.

5. The strip of claim 1 wherein the general thickness of the cross-section of said strip is uniform throughout the strip.

6. A surface strip to enhance the brightness of a table top when said table top is illuminated by at least one light source located above said table top, said strip having an upper surface and a lower surface, said strip comprising:

a plurality of facets to reflect light rays towards a center portion of said table top when said strip is disposed about a rim portion of said table top, wherein said facets are located on both the lower surface and the upper surface of said strip.

7. A surface strip to enhance the brightness of a table top when said table top is illuminated by at least one light source located above said table top, said strip having an upper surface and a lower surface, said strip comprising:

a plurality of facets to reflect light rays towards a center portion of said table top when said strip is disposed about a rim portion of said table top, wherein the general thickness of the cross-section of said strip is greater on one end thereof than the other.

8. A table mat to be used on a game table, said mat comprising:

an upper side;

a rim portion defining said upper side; and reflection strips disposed along said rim portion to reflect downwardly directed light rays toward a center of said upper side, each of said strips having an upper surface and a lower surface and being disposed with said lower surface down on said upper side of said mat.

9. The table mat of claim 8 wherein said each strip comprises a plurality of light-reflecting facets inclined to said upper side of said mat.

10. The table mat of claim 9 wherein said facets of said each strip are located on said upper surface of said each strip, and each of said facets of said each strip is inclined downwardly toward said center of said upper side.

11. The table mat of claim 9 wherein said facets of said each strip are located on said lower surface of said each strip, and each of said facets of said each strip is inclined upwardly toward said center of said upper side.

12. The table mat of claim 9 wherein said facets of said each strip are part of an array of grooves running parallel to at least a part of said rim portion.

13. The table mat of claim 8 wherein said strips are detachable from said mat.

14. The table mat of claim 8 wherein said strips are integral with said mat.

15. A game table comprising:

a table top;

a rim portion defining said table top; and reflection strips disposed along said rim portion to reflect downwardly directed light rays toward a center of said table top, each of said strips having an upper surface and a lower surface and being disposed with said lower surface down on said table top.

16. The game table of claim 15 wherein said each strip comprises a plurality of light-reflecting facets inclined to said table top.

17. The game table of claim 16 wherein said facets of said each strip are located on said upper surface of said each strip, and each of said facets of said each strip is inclined downwardly toward said center of said table top.

18. The game table of claim 16 wherein said facets of said each strip are located on said lower surface of said each strip, and each of said facets of said each strip is inclined upwardly toward said center of said table top.

19. The game table of claim 16 wherein said facets of said each strip are part of an array of grooves running parallel to at least a part of said rim portion.

20. The game table of claim 15 wherein said strips are detachable from said table top.

21. The game table of claim 15 wherein said strips are integral with said table top.

* * * * *